US006910422B2

(12) United States Patent
Haider et al.

(10) Patent No.: US 6,910,422 B2
(45) Date of Patent: Jun. 28, 2005

(54) METHOD FOR PRODUCING A COMBUSTIBLE CARTRIDGE CASE FOR CARTRIDGE AMMUNITION

(75) Inventors: Manfred Haider, Kirchdorf/Inn (DE); Alexander Huber, Karolinenfeld (DE); Annett Küchler, München (DE); Hans-Geroge Völkel, München (DE)

(73) Assignee: Nitrochemie Aschau GmbH, Aschau W. Inn (DE)

( * ) Notice: Subject to any disclaimer, the term of this patent is extended or adjusted under 35 U.S.C. 154(b) by 0 days.

(21) Appl. No.: 10/318,181

(22) Filed: Dec. 13, 2002

(65) Prior Publication Data

US 2003/0145753 A1 Aug. 7, 2003

(30) Foreign Application Priority Data

Dec. 15, 2001 (DE) ..... 101 61 727

(51) Int. Cl.[7] ..... F42B 5/18
(52) U.S. Cl. ..... 102/431; 86/1.1
(58) Field of Search ..... 102/431, 432, 102/433, 700; 86/19.5, 1.1

(56) References Cited

U.S. PATENT DOCUMENTS

| | | | | |
|---|---|---|---|---|
| 2,991,168 A | | 7/1961 | Nadel | |
| 3,260,203 A | | 7/1966 | Godfrey et al. | |
| 3,706,280 A | * | 12/1972 | Bobinski et al. | 102/465 |
| 3,770,563 A | * | 11/1973 | Bobinski et al. | 523/448 |
| 4,365,558 A | * | 12/1982 | Lippler et al. | 102/431 |
| 4,755,259 A | | 7/1988 | Larsson | |
| 5,338,407 A | | 8/1994 | Dasgupta | |
| 6,224,099 B1 | * | 5/2001 | Nielson et al. | 280/741 |

FOREIGN PATENT DOCUMENTS

| | | |
|---|---|---|
| DE | 19 09 701 A | 5/1870 |
| DE | 14 46 889 A | 4/1969 |
| DE | 40 22 991 C1 | 4/1992 |
| WO | WO 86/05175 A | 9/1986 |

OTHER PUBLICATIONS

Volkert, Bert, Highly Substituted Carboxymethyl Starch. 1996, Fraunhofer Institut Angewandte Polymerforschung, p. 1.*

* cited by examiner

*Primary Examiner*—Teri Pham Luu
*Assistant Examiner*—Susan C. Alimenti
(74) *Attorney, Agent, or Firm*—Marina V. Schneller; Venable LLP

(57) ABSTRACT

A method for producing a combustible cartridge case for cartridge ammunition, wherein an aqueous pulp containing nitrocellulose and cellulose fibers is produced, a raw felt is produced from the pulp through draining the fiber material on a sieve, and the raw felt is then compressed and shaped. To produce combustible cartridge cases possessing a greater mechanical stability than known cartridge cases of comparable dimensions, additives are mixed into the aqueous pulp prior to the production of the raw felt, to increase the stability of the fiber composite after the compressing process, so the breaking strength and the breaking elongation, and the resistance to tear propagation are increased. The additive is preferably a polymer material having a hydrophilic character and a high content of OH, $NH_2$ and/or similar functional groups, and is capable of forming chemical bonds and/or engaging in intermolecular interaction with the cellulose or nitrocellulose molecules.

3 Claims, No Drawings

METHOD FOR PRODUCING A COMBUSTIBLE CARTRIDGE CASE FOR CARTRIDGE AMMUNITION

CROSS-REFERENCE TO RELATED APPLICATION

This application is based on and claims the priority date of German Application No. 101 61 727.5 filed on Dec. 15, 2001, which is incorporated herein by reference.

BACKGROUND OF THE INVENTION

The invention relates to a method for producing a combustible cartridge case for cartridge ammunition.

In the known method, the combustible cartridge case is produced through a felting process comprising three basic work steps: preparing an aqueous pulp that contains nitrocellulose and cellulose fibers (fiber pulp); producing a raw felt by draining the fiber material on a sieve and squeezing the raw felt for the purpose of further draining; and compressing or compacting the fiber material to provide the final shape.

A drawback of cartridge cases produced in accordance with this known method is that, when used in ammunition with heavy projectiles, the cartridge cases must have a relatively thick wall to assure stability. Furthermore, known combustible cartridge cases that are exposed to high mechanical stresses (such as occur in a drop test or in automatic loading systems) are repeatedly damaged, which can prevent the cartridges from being loaded properly.

SUMMARY OF THE INVENTION

It is the object of the invention to provide a method that can be employed in a simple manner to produce combustible cartridges that possess greater mechanical stability than known cartridge cases of comparable dimensions.

The above object generally is achieved according to the invention by a method for producing a combustible cartridge case for cartridge ammunition, wherein: an aqueous pulp containing nitrocellulose and cellulose fibers is produced; a raw felt is created from the pulp by draining the fiber material on a sieve, and the raw felt is then compressed or compacted and shaped. Before the raw felt is produced or created, an additive comprising a polymer substance having a hydrophilic character is added to the aqueous pulp, with the additive possessing OH, $NH_2$ or another functional group that is capable of forming chemical bonds and/or engaging in intermolecular interaction with the cellulose or nitrocellulose molecules. Further, particularly advantageous, modifications of the invention are disclosed.

DESCRIPTION OF THE PREFERRED EMBODIMENTS

The invention is essentially based on the concept of modifying the above described known three step method of producing a combustible cartridge case by mixing an additive into the aqueous pulp prior to the production of the raw felt, which additive increases the stability of the fiber composite comprising nitrocellulose and cellulose fibers after the compressing process or compaction, which in turn increases the breaking strength and the breaking elongation of the material, as well as its resistance to tear propagation.

The additives are preferably polymer materials that have a hydrophilic character and a high content of OH, $NH_2$ and/or similar functional groups, and that form chemical bonds and/or engage in intermolecular interaction (e.g., hydrogen bridges) with the cellulose or nitrocellulose molecules.

Cationic and anionic modified and native starches, glucomannan and mannogalactan (e.g., cationic modified and amphoteric guar) and carboxymethylcellulose have proven the most advantageous additives.

In addition to the desired increase in the mechanical stability, the combustible cartridge cases produced in accordance with the invention have the advantage that, in poured or pressed ammunition, less blasting oil migrates out of the propellant and into the cartridge case than in known, comparable combustible cartridge cases.

Two practical examples are described below:

1. An aqueous pulp comprising 51% nitrocellulose, 48.1% cellulose and 0.9% acardite was mixed with (relative to the dry weight of the other pulp components) 0.5% cationic starch or 0.2% cationic guar or 1.0% carboxymethylcellulose (CMC). Sheet-like samples that all possessed virtually the same surface mass were then produced from the pulp according to the method. To assess the stability of the sheet-like fiber composite, the breaking strength and the breaking elongation of the material, the resilience and its resistance to tear propagation were determined. A sample formed according to the above recipe that did not contain the additive served as a comparison formula. As shown in the following table, the samples containing the additives exhibited significantly better values in all tests than the samples without the additives.

The invention now being fully described, it will be apparent to one of ordinary skill in the art that many changes and modifications can be made thereto without departing from the spirit or scope of the invention as set forth herein

| | Surface Mass [g/m$^2$] | Breaking Strength [N] | Breaking Elongation [%] | Resilience [Nmm] | Resistance to Tear Propagation [mNm/m] | Raw Density [Kg/dm$^3$] |
|---|---|---|---|---|---|---|
| No Add. | 101 | 21.1 | 1.6 | 22.6 | 769 | 0.45 |
| Cat. Starch | 101 | 32.3 | 2.4 | 50.3 | 1299 | 0.48 |
| Cat. Guar | 100 | 27.2 | 2.0 | 32.6 | 971 | 0.46 |
| CMC | 101 | 23.1 | 1.9 | 28.4 | 883 | 0.44 |

2. The additive of a cationic starch was mixed into 0.5% of a pulp from which the combustible cartridge cases were produced according to the above described felting process. The comparison of the cartridge cases with and without the starch additive revealed the following results in standard quality tests.

| | Tensile Strength [cN/dtex] | Compression Test [% compression] |
|---|---|---|
| No Additive | 22.64 | 1.70 |
| 0.5% Cationic Starch | 29.86 | 1.63 |

As can be seen, the tensile strength of the additive containing cartridge casings was increased considerably while the compression values (elasticity of the material) remained virtually the same.

The invention now being fully described, it will be apparent to one of ordinary skill in the art that many changes and modifications can be made thereto without departing from the spirit or scope of the invention as set forth herein.

What is claimed is:

1. A method for producing a combustible cartridge case for cartridge ammunition, comprising the steps of producing an aqueous pulp containing nitrocellulose and cellulose fibers; creating a raw felt from the pulp by draining the fiber material on a sieve; then compacting the raw felt into a final shape; and, before the step of creating the raw felt, adding a polymer substance having a hydrophilic character as an additive to the aqueous pulp, wherein the additive is at least one selected from the group consisting of starches, glucomannan, and mannogalactan, wherein the additive possesses at least one substituent selected from the group consisting of OH, $NH_2$ and any another functional group which either will form chemical bonds and/or (ii) engage in intermolecular interaction with the cellulose or nitrocellulose molecules.

2. A method for producing a combustible cartridge case for cartridge ammunition, comprising the steps of producing an aqueous pulp containing nitrocellulose and cellulose fibers; creating a raw felt from the pulp by draining the fiber material on a sieve; then compacting the raw felt into a final shape; and, before the step of creating the raw felt, adding a polymer substance having a hydrophilic character as an additive to the aqueous pulp, wherein the additive possesses at least one substituent selected from the group consisting of OH, $NH_2$ and any another functional group which either will form chemical bonds and/or (ii) engage in intermolecular interaction with the cellulose or nitrocellulose molecules, and wherein the additive is a mannogalactan which is selected from the group consisting of cationically modified guar and aniphoteric guar.

3. A method for producing a combustible cartridge case for cartridge ammunition, comprising the steps of producing an aqueous pulp containing nitrocellulose and cellulose fibers; creating a raw felt from the pulp by draining the fiber material on a sieve; then compacting the raw felt into a final shape; and, before the step of creating the raw felt, adding a polymer substance having a hydrophilic character as an additive to the aqueous pulp, wherein the additive possesses at least one substituent selected from the group consisting of OH, $NH_2$ and any another functional group which either will form chemical bonds and/or (ii) engage in intermolecular interaction with the cellulose or nitrocellulose molecules, and wherein the additive is cationic starch.

* * * * *